United States Patent [19]

Jagusch et al.

[11] 3,944,406

[45] Mar. 16, 1976

[54] CENTRIFUGAL PUMP FOR PUMPING LIQUIDS WITH HEAVY GAS CONTENT

[75] Inventors: Leonhard Jagusch, Leipzig; Werner Schönherr, Neukieritzsch; Dieter Weiske, Borna, all of Germany

[73] Assignee: VEB Chemieanlagenbau-und Montagekombinat, Leipzig, Germany

[22] Filed: June 20, 1974

[21] Appl. No.: 481,020

Related U.S. Application Data

[63] Continuation of Ser. No. 426,746, Dec. 20, 1973, abandoned.

[52] U.S. Cl. ..... 55/407; 415/109; 415/98

[51] Int. Cl.² ..... B01D 47/00

[58] Field of Search ..... 415/109, 106, 98; 417/69, 417/350, 422, 424, 98; 55/159, 178, 182, 183, 184, 189, 199, 201, 202, 203, 206, 207, 400, 401, 403, 406, 407, 408, 409, 467

[56] References Cited

UNITED STATES PATENTS

| | | | |
|---|---|---|---|
| 1,101,493 | 6/1914 | Houghton | 55/407 |
| 1,869,824 | 8/1932 | Richter | 417/199 A |
| 2,418,221 | 4/1947 | Curtis | 55/203 |
| 2,422,956 | 6/1947 | Edwards | 55/199 |
| 2,461,865 | 2/1949 | Adams | 55/199 |
| 2,575,568 | 11/1951 | Topanelian, Jr. | 55/400 |
| 2,761,393 | 9/1956 | Stefano et al. | 55/201 |
| 2,850,983 | 9/1958 | Adams | 417/69 |
| 2,888,097 | 5/1959 | Scheffler, Jr. | 55/400 |
| 2,942,687 | 6/1960 | Kollander | 55/407 |
| 2,954,841 | 10/1960 | Reistle, Jr. | 55/57 |
| 3,031,974 | 10/1962 | McMahan | 417/424 |
| 3,213,797 | 10/1965 | McMahan | 417/424 |
| 3,686,831 | 8/1972 | Libby | 417/69 |

FOREIGN PATENTS OR APPLICATIONS

| | | | |
|---|---|---|---|
| 101,532 | 11/1925 | Austria | 55/407 |
| 7,259 | 4/1907 | France | 55/407 |
| 1,205,723 | 8/1959 | France | 55/407 |
| 7,401 | 8/1922 | Netherlands | 55/407 |
| 492,925 | 2/1930 | Germany | 415/116 |
| 368,879 | 3/1939 | Italy | 415/53 |
| 126,772 | 2/1932 | Austria | 415/106 |
| 861,775 | 11/1940 | France | 417/199 A |
| 2,016,887 | 11/1970 | Germany | 415/109 |
| 133,802 | 10/1919 | United Kingdom | 415/109 |
| 212,879 | 1/1924 | United Kingdom | 415/109 |
| 305,030 | 4/1955 | Switzerland | 415/109 |

*Primary Examiner*—Henry F. Raduazo
*Attorney, Agent, or Firm*—Nolte and Nolte

[57] ABSTRACT

This invention is concerned with a centrifugal pump, particularly adapted for pumping liquids with a heavy gas content. To separate the gases from the liquids the impeller is provided with ducts leading from the central inlet to the peripheral outlet of the pump, the ducts being of progressively smaller cross section from the inlet to the outlet and openings are provided through the impeller disc for the escape of gases. There are a plurality of openings and the cross sectional area presented by the openings for the escape of gas is progressively lesser from the inlet region to the outlet region.

15 Claims, 4 Drawing Figures

CENTRIFUGAL PUMP FOR PUMPING LIQUIDS WITH HEAVY GAS CONTENT

Figure 1:
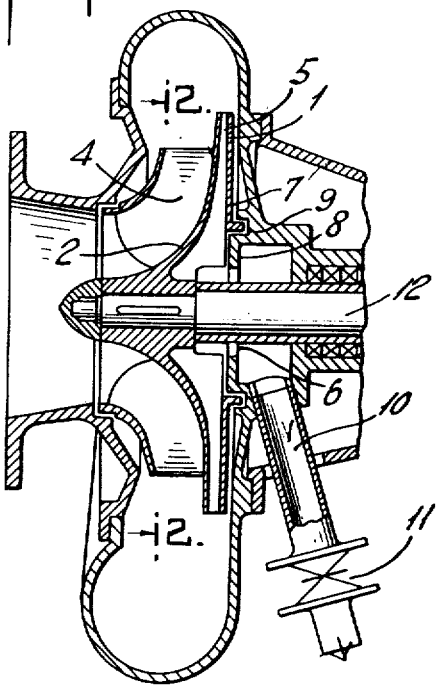

This application is a continuation of application Ser. No. 426,746, filed Dec. 20, 1973 now abandoned.

The invention concerns a centrifugal pump for pumping liquids with heavy gas content, particularly, but not necessarily exclusively, it is concerned with a pump for emulsified fermentation media.

Centrifugal pumps are normally not capable of pumping liquids and gases simultaneously. The strong centrifugal forces appearing in the rotor of the centrifugal pump cause a separation of the liquid and gas phases.

In the proximity of the hub of the rotor, a core of gas or foam is formed, which leads to a reduction of the delivery rate of the pump or makes the output of the pump cease altogether.

Centrifugal pumps are known, in which by generating additional turbulence in the rotor and/or by generating turbulence ahead of or behind the rotor, which reaches into the rotor, the separated gas is turbulently mixed with the liquid again and again so that the gas may be pumped with the liquid.

Known are further centrifugal pumps for the intermittent pumping of gas-containing liquids during start-up for evacuating the suction line, which are coupled with jet, side channel or positive displacement pumps in such a manner that the gas or foam core which is formed in the rotor of the centrifugal pump is suctioned off through holes near the hub and the gas or foam is mostly transported along through the volumetrically smaller jet, side channel or positive displacement pump into the pressure outlet.

According to another known solution for venting the suction line and the rotor of centrifugal pumps with auxiliary suction devices which can be engaged and disengaged, the rotor of the centrifugal pump is likewise provided with holes near the hub and additionally, on its rear side, with blades having centrifugal action. In such an arrangement, a conduit with its inlet near the hub or directly in the hub of the rotor on the rear side of the rotor to lead the gas to the auxiliary pumping device. This is to ensure that the dirt particles which enter the blade space on the rear side of the rotor through the openings near the hub with the foam are thrown off radially by the centrifugal forces and cannot get into the delicate auxiliary suction devices.

All the known centrifugal pumps have the disadvantage that the hydraulic efficiency, particularly when pumping liquids with heavy gas content, is considerably lower than that of centrifugal pumps for pumping pure liquids.

This reduction of the efficiency is the automatic consequence of the desired substantial increase of the turbulence in the rotor. Although the core of foam that forms in the vicinity of the hub is carried away through the holes near the hub and stable operation of the pump is thereby assured, the gas separates out continuously in the entire rotor channel and flows back to the rotor hub against the transport direction in the rotor.

The centrifugal forces in the rotor, which cause the separation of the gas-containing flow medium, increase with the square of the radial rotor dimensions. The backward flow of gas mentioned reduces, for one, the cross-sectional area for the liquid in the rotor channels, which results in lower output, and also leads to additional turbulence losses in the rotor, which lessens the hydraulic efficiency even more. To this is added that the jet, side channel or positive displacement pumps used for exhausting the foam through the openings in the rotor near the hub have a relatively low hydraulic efficiency, as they must be laid out for pumping a two-phase system. This not inconsiderable power requirement further reduces the overall efficiency of these combination pumps.

It is an object of the invention to improve the hydraulic efficiency of centrifugal pumps for pumping liquids with heavy gas content and to thereby reduce the energy required.

The invention addresses itself to the problem of developing a centrifugal pump which permits to pump gas-containing liquids with a gas content of over 50%, stably with a minimum of energy losses and continuously.

According to the invention, the problem is solved by providing a plurality of spaced openings in the rotor disc, near the rotor blade intake side, i.e., the trailing side of the blades, the eye of the openings being progressively smaller from the root of the blade to the blade tips. Alternatively or additionally, the spacing between adjacent openings becomes larger from the roots of the blades to the blade tips. Preferably, the cross sections of the channels of the rotor defined by adjacent blades are reduced in the flow direction, i.e., in the radially outer regions of the rotor, as compared to a design for pumping pure liquids, to take account of the reduction in volume of the gas-containing flow medium by the removal of foam from the rotor channels through the openings and by the compression of the gas remaining in the flow medium.

In this way, the gas in the form of foam, which is continuously separated from the gas-containing flow medium toward the suction side of the blades in the entire rotor channel, escapes through the openings, which act as choke points, without back flow to the rotor hub and the inherent retardation of the flow in the rotor channel due to the volume reduction of the pumped flow, which favors separation of the flow from the wall and thus, major losses are avoided.

By this arrangement, the turbulence losses automatically occurring due to the stratification of the nonhomogeneous medium in the rotor channel and the volume reduction are therefore reduced to a minimum.

According to a further feature of the invention, there are arranged on the rear side of the rotor hub disc blades acting centrifugally in a manner known per se, of which at least some extend from a point radially inwardly of the openings of the hub disc nearest to the rotor axis to a point radially outwardly of the tips of the blades on the front sides of the rotor. In such an arrangement, blades other than those extending from a point inwardly of the radially innermost openings of the rotor disc also extend to a point radially outwards of the tips of the blades in the front side of the rotor. In this way, the area of the openings on the rear side of the rotor remains free of pumped liquid and the foam leaving via the rotor openings in this area is separated by the impact and centrifugal forces acting on it into pumped liquid, which is pumped by the blades designed only for the pumping of liquid into the pressure chamber of the pump with low hydraulic losses, and into gas, which in accordance with the invention, is removed via one or several gas discharge conduits. The discharge conduits have their inlets disposed radially inwardly of the openings of the rotor disc nearest to the axis and extend to a gas pumping device designed for pure gas pumping which draws off the gas with high efficiency.

Back flow of pumped liquid from the pressure chamber or volute of the pump into the gas discharge conduits is prevented in single-flow pumps by the provision that in accordance with the invention a disc, which is generally provided in single-flow rotors and covers up the blades on the rear side of the hub disc, ends at a greater radial distance from the axis than the blades on the front side of the hub disc, and that this disc, together with the pump housing, there forms a choke gap in the manner known per se, and that between the pump housing and the part of the blades that is not covered up a gap as small as possible exists. The flow of liquid penetrating the choke gap is thereby pumped back into the pressure chamber (or volute) of the pump by the backflow blades of the rotor.

The exhaust device for the gas separated in the centrifugal pump requires additional machinery and power. However, the exhaust device can be eliminated completely if in accordance with the invention the input pressure at the pump is chosen so high that the pressure at the rear of the hub disc in the vicinity of the holes is greater than the pressure in the space, into which the gas exhaust conduits extend.

According to the invention, a choke or valve member is provided in the gas exhaust line for adaption to the pumping conditions in each case.

The gas discharge can thereby be controlled in such a manner, in contrast to other known centrifugal pumps with gas exhaust from the rotor, that pumped liquid is no longer sucked off or escapes with the gas if, for instance, the gas content in the pumped liquid is lower than that for which the pump is normally designed.

The advantages of the solution according to the invention are that liquids with a heavy gas content of up to more than 50% can be pumped reliably and efficiently.

With experimental pumps having a rated output of, for instance, 2000 $m^3$/hour, hydraulic efficiencies were obtained which, for a flow medium with 40% gas content, are 90 to 95% of those attainable with homogeneous liquids.

Figure 2:
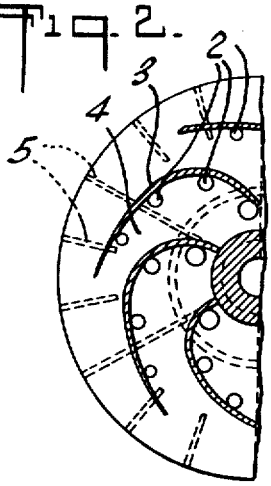
Figure 3:
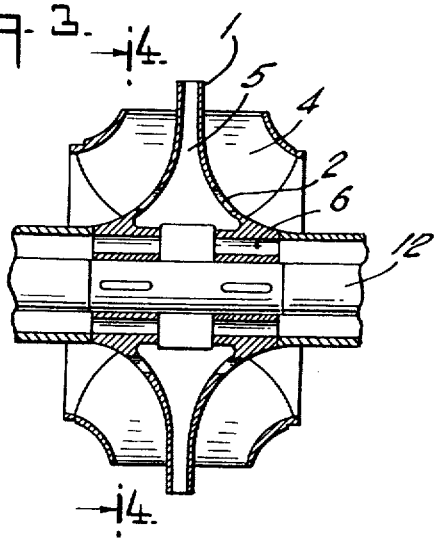
Figure 4:
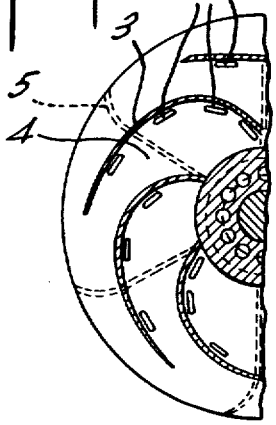

The solution according to the invention will be explained in further detail in the following, making reference to two examples of embodiments. In the attached drawings:

FIG. 1 is an axial cross section through a single-stage centrifugal pump according to the invention, FIG. 2 is a half section on the line 2—2 of FIG. 1, FIG. 3 is an axial cross section through a rotor of another embodiment of the invention, and FIG. 4 is a half section on the line 4—4 of FIG. 3.

FIG. 1 illustrates a single-stage centrifugal pump, in which a rotor consisting of a hub disc 1, front rotor blades 3, the blades 5 on the rear side of the hub disc and cover disc 7, is arranged in a pump housing 8 on a drive shaft 12. In the hub disc 1 of the rotor are arranged, as will be seen in FIG. 2, in the immediate vicinity of the intake or trailing side of the rotor blades 3, a plurality of openings 2, which are approximately equally spaced apart and which are progressively smaller from the root of the blade towards its tip.

The cross sections of the rotor channels 4 defined between adjacent blades 3 become smaller in the direction of liquid flow, i.e., from roots to tips of the blades, than in a design for pure liquid pumping to an extent, corresponding to the reduction in volume of the gas-containing medium due to the removal of foam from the channels 4 through the openings 2 and the compression of the gas still remaining in the flow medium.

Some of the radially arranged blades 5 on the rear side of the hub disc 1 begin at a smaller distance from the axis than that of the openings 2 nearest to the axis. All the blades 5, the hub disc 1 and the cover disc 7 terminate at a substantially greater radial distance from the axis than do the longer blades 3 and, together with the pump housing 8 form there a choke gap 9.

Between those parts of the longer blades 5, which are not covered by disc 7, and the pump housing 8, there is only a small gap. At a smaller radial distance from the axis than that of the openings 2 in the hub disc 1 nearest to the axis, an annular gas exhaust conduit 6 begins, which is in connection with a gas exhaust line 10. A choke or valve member 11 is arranged in the gas exhuast line 10.

FIGS. 3 and 4 show to the invention embodied in a doubleflow rotor.

On the drive shaft 12, a double-flow rotor with centrifugal action is arranged, which consists of the hub discs 1, the rotor blades 3 and the blades 5 which are arranged between the two hub discs 1. In the immediate vicinity of the intake side of the rotor blades 3 are arranged in the hub discs 1 of the rotor, beginning at the root of the blades up to the vicinity of the blade tip, openings 2 of equal size, which are arranged at spacings which become progressively larger from the blade roots to the tips. The cross sections of the rotor channels 4 become additionally smaller in the flow direction than in a design for pure liquid pumping. Blades 5 between the discs 1 are curved forward and begin at a smaller distance from the axis than that of the openings 2 nearest to the axis.

All the blades 5 and the hub discs 1 end at a greater radial distance from the axis than do the rotor blades 3. Several gas exhaust conduits 6 open to the hub at a smaller radial distance from the axis than that of the radially innermost opening 2 in disc 1 and the conduits lead to gas exhaust lines with choke or valve members.

When pumping a gas-containing liquid with a pump according to FIGS. 1 and 2 or a pump having a rotor according to FIGS. 3 and 4, the gas, which is continuously separated over the length of channels 4 toward the intake side of the rotor blades 3 due to the centrifugal forces, escapes in the form of foam through the openings 2 in discs 1 and passes to the rear sides of the discs. By the additional reduction of the cross section of the channels between the blades over a design for pure liquid pumping, retardation of the flow due to volume reduction of the pumped flow is avoided here. The foam passing to the rear of the hub through the openings 2 separates into pumped liquid and gas under the action of the centrifugal forces. The liquid component of the foam is pumped by the blades 5 on the rear side of the hub discs 1 into the pressure chamber of the pump. Through the longer radial extent of the blades 5 as compared to the rotor blades 3 one achieves that the area of the openings 2 on the rear side of the disc 1 remains free of pumped liquid.

The gas is either exhausted via the gas discharge conduits 6, the gas exhaust line 10 and the choke member 11 by means of a suitable device or escapes by itself via that path. The gas flow is controlled by means of the choke member 11 in such a manner that only so much foam escapes from the rotor channels 4 through the openings 2 in the hub discs 1 as is separated according to the gas content of the flow medium.

The flow medium, which in the case of a pump according to FIGS. 1 and 2 passes through the choke gap 9 between the cover disc 7 and the pump housing 8 from the pressure chamber of the pump to the area of the blades 5 on the rear side of the hub disc 1, is pumped back into the pressure space of the pump by the blades 5.

We claim:

1. A centrifugal pump capable of handling liquids with a heavy gas content comprising a housing, a rotatable impeller disc disposed within the housing, a generally axial inlet opening to one side of the impeller disc and an outlet at the periphery of the impeller disc, said impeller disc comprising a plurality of impeller blades on said one side thereof, said blades extending from a central region to a peripheral region of the disc and defining between adjacent ones thereof ducts leading from a central region of the disc to the periphery thereof, said ducts being of progressively lesser cross section from radially inner portions thereof to radially outer portions thereof, a plurality of impeller blades on the other side of the disc extending from a peripheral region of the disc toward a central region thereof, said blades on said one side of the disc having leading and trailing sides, said disc having a plurality of openings in each duct, said openings being disposed adjacent said trailing sides of said blades on said one side of the disc and communicating with said other side of the disc, each said plurality of openings comprising openings of similar cross sectional area and the spacing between said openings being progressively greater from a central to a peripheral region of said disc, said openings being constituted as means passing a gaseous phase of a pumped medium to said other side of the disc and means communicating with a central region of the housing adjacent said other side of the disc for removal of said gaseous phase.

2. A pump as claimed in claim 1 wherein said means communicating with said other side of the disc for removal of the gaseous phase of the medium comprises conduit means opening adjacent central region of the disc, said region at which said conduit opens being radially inwards of the radially innermost opening of said plurality of openings in the disc.

3. A pump as claimed in claim 1 wherein radially outermost portions of each blade of said plurality of blades on said other side of the disc are disposed radially outwardly of radially outermost portions of each said blade of said plurality of blades on said one side of the disc and wherein at least some of said blades of said plurality of blades on said other side of the disc have radially inner ends disposed at least as close to the disc axis as the radially innermost ones of said plurality of openings in the disc.

4. A pump as claimed in claim 1 wherein said impeller disc includes a disc-like portion secured to said plurality of blades on said other side of said impeller disc, said disc-like portion being secured to edges of said last mentioned blades remote from said other side of said impeller disc, said disc-like portion having a central circular opening, the marginal edges of said central circular opening being disposed radially outwardly of innermost portions of at least some of the blades of said plurality of blades on said other side of the impeller disc, said marginal edges and an adjacent housing portion defining therebetween a throttling clearance.

5. A pump as claimed in claim 1 wherein said means for removal of said gaseous phase of the medium comprises a conduit, said conduit including a throttling element.

6. A centrifugal pump capable of handling liquids with a heavy gas content comprising a housing, a rotatable impeller disc disposed within the housing, a generally axial inlet opening to one side of the impeller disc and an outlet at the periphery of the impeller disc, said impeller disc comprising a plurality of impeller blades on said one side thereof, said blades extending from a central region to a peripheral region of the disc and defining between adjacent ones thereof ducts leading from a central region of the disc to the periphery thereof, said ducts being of progressively lesser cross section from radially inner portions thereof to radially outer portions thereof, a plurality of impeller blades on the other side of the disc extending from a peripheral region of the disc toward a central region thereof, said blades on said one side of the disc having leading and trailing sides, said disc having a plurality of openings in each duct, said openings being disposed adjacent said trailing sides of said blades on said one side of the disc and communicating with said other side of the disc, each said plurality of openings comprising openings of which each of those closer to the center of the disc is of greater cross sectional area than those more remote from said center of said disc and said openings being equally spaced from one another, said openings being constituted as means passing a gaseous phase of a pumped medium to said other side of the disc and means communicating with a central region of the housing adjacent said other side of the disc for removal of said gaseous phase.

7. A pump as claimed in claim 6 wherein radially outermost portions of each blade of said plurality of blades on said other side of the disc are disposed radially outwardly of radially outermost portions of each said blade of said plurality of blades on said one side of the disc and wherein at least some of said blades of said plurality of blades on said other side of the disc have radially inner ends disposed at least as close to the disc axis as the radially innermost ones of said plurality of openings in the disc.

8. A pump as claimed in claim 6 wherein said means communicating with said other side of the disc for removal of the gaseous phase of the medium comprises conduit means opening adjacent central region of the disc, said region at which said conduit opens being radially inwards of the radially innermost opening of said plurality of openings in the disc.

9. A pump as claimed in claim 6 wherein said impeller disc includes a disc-like portion secured to said plurality of blades on said other side of said impeller disc, said disc-like portion being secured to edges of said last mentioned blades remote from said other side of said impeller disc, said disc-like portion having a central circular opening, the marginal edges of said central circular opening being disposed radially outwardly of innermost portions of at least some of the blades of said plurality of blades on said other side of the impeller disc, said marginal edges and an adjacent housing portion defining therebetween a throttling clearance.

10. A pump as claimed in claim 6 wherein said means for removal of said gaseous phase of the medium comprises a conduit, said conduit including a throttling element.

11. A centrifugal pump capable of handling liquids with a heavy gas content comprising a housing, a rotatable impeller disc disposed within the housing, a generally axial inlet opening to one side of the impeller disc and an outlet at the periphery of the impeller disc, said impeller disc comprising a plurality of impeller blades on said one side thereof, said blades extending from a central region to a peripheral region of the disc and defining between adjacent ones thereof ducts leading from a central region of the disc to the periphery thereof, said ducts being of progressively lesser cross section radially inner portions thereof to radially outer portions thereof, a plurality of impeller blades on the other side of the disc extending from a peripheral region of the disc toward a central region thereof, said blades on said one side of the disc having leading and trailing sides, said disc having a plurality of openings in each duct, said openings being disposed adjacent said trailing sides of said blades on said one side of the disc and communicating with said other side of the disc, each said plurality of openings comprising openings of which each of those closer to the center of the disc is of greater cross sectional area than those more remote from said center of said disc and the spacing between said openings being progressively greater from a central to a peripheral region of said disc, said openings being constituted as means passing a gaseous phase of a pumped medium to said other side of the disc and means communicating with a central region of the housing adjacent said other side of the disc for removal of said gaseous phase.

12. A pump as claimed in claim 11 wherein radially outermost portions of each blade of said plurality of blades on said other side of the disc are disposed radially outwardly of radially outermost portions of each said blade of said plurality of blades on said one side of the disc and wherein at least some of said blades of said plurality of blades on said other side of the disc have radially inner ends disposed at least as close to the disc axis as the radially innermost ones of said plurality of openings in the disc.

13. A pump as claimed in claim 11 wherein said means communicating with said other side of the disc for removal of the gaseous phase of the medium comprises conduit means opening adjacent central region of the disc, said region at which said conduit opens being radially inwards of the radially innermost opening of said plurality of openings in the disc.

14. A pump as claimed in claim 11 wherein said impeller disc includes a disc-like portion secured to said plurality of blades on said other side of said impeller disc, said disc-like portion being secured to edges of said last mentioned blades remote from said other side of said impeller disc, said disc-like portion having a central circular opening, the marginal edges of said central circular opening being disposed radially outwardly of innermost portions of at least some of the blades of said plurality of blades on said other side of the impeller disc, said marginal edges and an adjacent housing portion defining therebetween a throttling clearance.

15. A pump as claimed in claim 11 wherein said means for removal of said gaseous phase of the medium comprises a conduit, said conduit including a throttling element.

* * * * *